United States Patent [19]

Oschatz

[11] Patent Number: 4,501,589

[45] Date of Patent: Feb. 26, 1985

[54] PROCESS FOR DYEING OR PRINTING SIZED TEXTILES

[75] Inventor: Christian Oschatz, Schallbach, Fed. Rep. of Germany

[73] Assignee: Sandoz Ltd., Basle, Switzerland

[21] Appl. No.: 503,271

[22] Filed: Jun. 10, 1983

[30] Foreign Application Priority Data

Jun. 11, 1982 [DE] Fed. Rep. of Germany ..... 3222080

[51] Int. Cl.[3] ..... D06P 1/44; D06P 3/42

[52] U.S. Cl. ..... 8/495; 8/531; 8/532; 8/534; 8/904; 8/918; 8/921; 8/922; 8/924; 8/927

[58] Field of Search ..... 8/495

[56] References Cited

U.S. PATENT DOCUMENTS 3,893,806 7/1975 Finch et al. ..... 8/495

4,329,147 5/1982 Harris ..... 8/636

FOREIGN PATENT DOCUMENTS 1496809 1/1978 United Kingdom .

*Primary Examiner*—A. Lionel Clingman

*Attorney, Agent, or Firm*—Gerald D. Sharkin; Richard E. Vila; Thomas C. Doyle

[57] ABSTRACT

A process for dyeing or printing sized textiles comprising applying to the sized substrate a dyeing liquor or a printing paste which contains, in addition to the dyestuffs (i) a compound or a mixture of compounds selected from compounds having solubilizing, washing, emulsifying, dispersing or dye fixation accelerating properties, and (ii) a textile size or a mixture of textile sizes.

26 Claims, No Drawings

PROCESS FOR DYEING OR PRINTING SIZED TEXTILES

The present invention relates to a process for dyeing or printing sized textiles.

During the weaving of textiles, the warp threads are normally protected against breakage by application of a size. The presence of size on the warp threads interferes with finishing processes such as bleaching and dyeing, and complete removal of the size is highly desirable to obtain an even treatment, e.g. even dyeings. Such a removal requires energy, time and additional chemicals.

It has now been found that sized textiles can be dyed or printed directly without any preliminary de-sizing treatment, the resulting dyeings and printings having a good degree of levelness.

Accordingly, the present invention provides a process for dyeing or printing sized testiles comprising applying to the sized substrate a dyeing liquor or a printing paste which comprises, in addition to the dyestuffs.

(i) a compound or a mixture of compounds selected from compounds having solubilizing, washing, emulsifying, dispersing or dye fixation accelerating properties, and (ii) a textile size or a mixture of textile sizes.

Suitable components (i) include non-ionic, anionic or cationic surfactants and their mixtures, water soluble or -insoluble non-surfactant dyeing assistants and their mixtures having at least one of the above indicated properties. Preferred components (i) are non-ionic, anionic or cationic surfactants and mixtures of these.

Preferably the non-ionic surfactants as component (i) have a HLB value of from 1 to 20. Preferred non-ionic surfactants include propylene oxide/ethylene oxide block polymers such as are available under the Trade Mark Pluronic;

addition products of $C_{2-3}$ alkylene oxide, preferably from 1 to 100 moles $C_{2-3}$ alkylene oxide, more preferably ethylene oxide, with fatty alcohols, preferably aliphatic $C_{5-22}$ alcohols, more preferably $C_{5-18}$ alcohols e.g. lauryl alcohol, oleyl alcohol etc.

addition products of $C_{2-3}$alkylene oxide, preferably from 5 to 200 moles $C_{2-3}$ alkylene oxide, more preferably ethylene oxide with fatty amines, preferably aliphatic fatty amines or polyamines in which the fatty group contains from 5 to 22 carbon atoms, preferably from 5 to 18 carbon atoms, e.g. dodecylamine, stearylamine or tallow tatty amine;

fatty acid polyglycol esters, preferably polyoxyethylene esters of $C_{5-22}$ fatty acids, more preferably of $C_{5-18}$ saturated or unsaturated carboxylic acids, e.g. oleic, stearic, palmitic or myristic acid or their mixtures;

ethoxylated fatty acid alkanolamides, preferably ethoxylated alkanolamides of the fatty acids indicated above; and addition products of $C_{2-3}$alkylene oxide, preferably from 1 to 30 moles $C_{2-3}$ alkylene oxide, more preferably ethylene oxide, with linear or branched higher alkyl substituted phenols, preferably $C_{5-18}$-alkyl- or -dialkyl-phenols, e.g. isooctylphenol, di-tert.-butylphenol, nonylphenol or dodecylphenol.

Suitable anionic surfactants as component (i) include:

fatty acids and their alkali metal, ammonium and organic base salts;

the carboxylation products, preferably carboxymethylation products, of the ethoxylated fatty alcohols indicated above, sulphates and sulphonates of fatty acids, fatty acid esters and fatty acid amides;

linear or branched $C_{5-18}$ alkyl sulphates and sulphonates;

sulphates of the ethoxylation products indicated above as non-ionic surfactants;

polycarboxylic acid ester sulphonates;

$C_{5-18}$alkylbenzenesulphonates and $C_{1-4}$-alkyl- or dialkyl-$C_{1-4}$-naphthalenesulphonates, the term "fatty acid" meaning a $C_{5-22}$, preferably $C_{5-18}$ long chain saturated or unsaturated carboxylic acid, and sulphates and sulphonates including the alkali metal, ammonium and organic base salts.

Suitable cationic surfactants as component (i) include compounds whose molecules contain at least one lipophilic aliphatic residue having at least 5 carbon atoms, and at least one cationic nitrogen atom, preferably a quaternary amino group. The aliphatic residue may be in the form of an alkyl, alkenyl or acyl group, and preferably contains from 5 to 22, more preferably 5 to 18 carbon atoms. Any other alkyl groups in the molecule may contain up to 22 carbon atoms, but are preferably lower alkyl groups containing up to 4 carbon atoms. Examples of such cationic surfactants include more particularly quaternization products of $C_{5-22}$alkyl/alkenyl amines or -polyamines, e.g. poly $C_{2-6}$ alkylene polyamines.

Particularly preferred components (i) are anionic and non-ionic surfactants and their mixtures. Most preferred non-ionic surfactants are the addition products of from 1 to 100 moles, preferably 1 to b 30 moles, especially 1 to 15 moles, ethylene oxide with $C_{5-18}$, preferably $C_{10-18}$aliphatic alcohols, e.g. lauryl alcohol and its branched homologues and isomers.

Preferred anionic surfactants are the carboxymethylation products of the preferred ethoxylated $C_{5-18}$ aliphatic alcohols.

Preferably component (i) is a mixture of non-ionic and anionic surfactants, especially a mixture of $C_{10-18}$ aliphatic alcohols ethoxylated with 1 to 30 moles ethylene oxide, together with their carboxymethylation products. A preferred ratio of non-ionic: anionic surfactant is from 40:60 to 60:40 especially 50:50.

By textile sizes as component (ii) are to be understood sizes which are useful for sizing the warp threads during weaving. Suitable sizes include starches, for example potato, maize or rice starches, cellulose derivatives, e.g. carboxymethylcellulose, hydroxymethyl cellulose or methyl or ethyl cellulose, natural gums, e.g. locust bean gum or tragacanth, proteins e.g. glue, gelatine or casein, modified polysaccharides, polyvinyl alcohol, polyvinyl acetate, polyacrylates or polymethacrylates and their copolymers, styrene-maleates, hydrosoluble polyesters, polyethyleneglycols, saponifiable sulphited wax, oil or paraffin emulsions, synthetic waxes, stearic acid and triglycerides. Such sizes are commercially available. They may advantageously be used as mixtures.

Preferably the size used as component (ii) is one that is normally applied during weaving of the substrate being treated, particularly on the warp threads. More preferably, it is the same as the one already present on the substrate.

Component (i) is preferably contained in the dyeing liquor or printing paste in an amount from 1 to 100 g/l, more preferably from 30 to 70 g/l, especially from 30 to 50 g/l in the dyeing liquor and from 30 to 70 g/l in the printing paste.

Component (ii) is advantageously contained in the dyeing liquor or printing paste in an amount from 0.1 to 20%, preferably from 0.5 to 12%, more preferably from 0.5 to 5% dry weight based on the weight of the sized substrate (1-120 g/l, preferably 5-14 70 g/l size).

Components (i) and (ii) may be added to the dyeing liquor or printing paste either in form of a composition or separately.

The process of the invention can be applied to a large variety of textiles which are sized during weaving. As will be appreciated, while still being sized the substrate is dyed or printed. A partial de-sizing of the substrate may take place during the dyeing or printing but only to a low extent.

Suitable textiles which can be dyed or printed according to the process of the invention include various fibre types and their blends, e.g. cellulosic textiles comprising natural or regenerated cellulose, for example cotton, cellulose acetate, polyester, polyamides and polyacrylonitrile. The process of the invention is particularly advantageous for dyeing or printing textiles which are dyeable with disperse dyes, more preferably textiles comprising cellulose acetate especially cellulose triacetate or hemipentacetate.

The dyestuffs which may be used according to the process of the invention are selected in accordance with the affinity of the textile and the dyeing or printing conditions. Depending on the textile substrate anionic, cationic and disperse dyestuffs may be employed. However, as indicated above, disperse dyestuffs are preferred.

In addition to the dyestuffs and components (i) and (ii), the dyeing liquor or printing paste may contain further dyeing assistants, e.g. as conventionally employed for the dyeing or printing of the textiles listed above, for example a buffer, ammonium sulphate, acetic or formic acid, sodium dihydrogenophosphate, thickening agent, urea, migration inhibitor, reduction inhibitor, a carrier and the like. It may in particular be recommended to add one or more organic solvents to the dyeing liquor in order to dissolve the waxes, oils and fats from the substrate, including the oil staining from the weaving machine. Such organic solvents are known. Preferred organic solvents are glycols e.g. hexylene glycol, and white spirit. The amount of organic solvents added may be up to 50%, preferably from 10 to 20%, by weight based on the total weight of the added size and dyeing assistants.

The dyeing and printing can be carried out according to known methods. Dyeing may be effected by exhaust as well as continuously, for example at a temperature from room temperature to H.T. conditions (about 140° C.). Fixation of the dyeings or printings may be carried out in accordance with known methods, e.g. at a temperature of from room temperature to 230° C. for 1 second to 48 hours, with saturated or superheated steam or hot air, under pressure or normal pressure conditions, optionally with an intermediary drying step. The sized textiles may for example be dyed or printed according to the Pad-Roll, Pad- or Print-Steam, Pad- or Print-Thermofixation procedures, the methods of a minimum liquor application such as foam application or spraying, and the like.

After fixation of the dyeings and printings, the textiles are after-treated in a known manner, e.g. conventionally soaped or subjected to reductive after-clearing, rinsed and dried. Complete removal of the size takes place simultaneously during the conventional after-treatment subsequent to fixation.

According to a preferred embodiment of the invention the sized textile, preferably cellulose acetate, especially hemipentaacetate is dyed in accordance with the Pad-Roll method at a temperature from 60° to 90° C., preferably from 70° to 80° C., the storage period being from 5 minutes to 4 hours, preferably from 2 to 3 hours.

As a result of the process of the invention, the textile substrate is simultaneously de-sized and evenly dyed or printed.

A dyeing liquor or printing paste comprising components (i) and (ii) and optionally an organic solvent forms also part of the invention, component (i) being preferably a mixture of non-ionic and anionic surfactants as indicated above and the organic solvent being preferably hexylene glycol. The dyestuffs present in such a liquor or paste are preferably disperse dyestuffs.

The following Examples further serve to illustrate the invention. All temperatures are in degrees Centigrade.

EXAMPLE 1

A sized hemipenta-acetate crepe fabric (raw material sized e.g. with a mixture of polyacrylates) is padded on a pad-roll installation with a liquor containing.

35 g/l of the commmercially available dyestuff C.I. Disperse Orange 30

10 g/l of the commercially available dyestuff C.I. Disperse Red 167

20 g/l of the commercially available dyestuff C.I. Disperse Blue 73

10 g/l (solids) of a commercially available size based on polyacrylate (Size T8, BASF), dissolved in water 5 g/l (solids) of a commercially available size based on polyvinyl alcohol (Varinol, Hoechst)

35 g/l of commercially available mixture of tetramethyllauryl alcohol ethoxylated with an average of 6-10 moles ethylene oxide and the carboxymethylation product thereof 15 g/l hexylene glycol, and 2 g/l ammonium sulphate.

The liquor is adjusted to pH 5 with acetic acid. The fabric is squeezed to 40% pickup based on the dry weight of the fabric and maintained at 80° for 3 hours.

There is obtained an even dark brown dyeing.

EXAMPLE 2

By following the procedure of Example 1 but using a padding liquor containing 100 g/l of the commercially available dyestuff Foron Navy Blue E-2BL gran.$^R$ (Registered Trade Mark; Sandoz Ltd., Switzerland)

20 g/l of the commercially available size based on polyacrylate, dissolved in water 2 g/l ammonium sulphate 35 g/l of commercially available tetramethyllauryl alcohol ethoxylated with an average of 6 to 10 moles ethylene oxide and its carboxymethylation derivative 80 g/l of a commercially available size based on polyvinylacetate, and 15 g/l hexylene glycol, there is obtained a fabric evenly dyed in a deep navy blue shade.

What is claimed is:

1. A process for dyeing or printing a warp sized woven textile substrate which comprises applying to said sized substrate a dyeing liquor or printing paste comprising, in addition to one or more dyestuffs, (i) a non-ionic, anionic or cationic surfactant thereof and (ii) a textile size or mixture of textile sizes.

2. A process according to claim 1, in which component (i) is a non-ionic or anionic surfactant or a mixture of these.

3. A process according to claim 1, in which component (i) is a mixture of an addition product of 1 to 30 moles ethylene oxide with a $C_{5-18}$aliphatic alcohols and the carboxymethylation product of $C_{5-18}$aliphatic alcohol ethoxylated with 1 to 30 moles ethylene oxide.

4. A process according to claim 1, in which component (i) is present in the dyeing liquor or printing paste in an amount from 1 to 100 g/l.

5. A process according to claim 1, in which component (ii) is present in the dyeing liquor or printing paste in an amount from 0.1 to 20% dry weight based on the weight of the sized substrate.

6. A process according to claim 1, in which the dyeing liquor or printing paste further contains an organic solvent.

7. A process according to claim 1 in which the dyeing liquor or printing paste contains a disperse dyestuff and the substrate is a substrate dyeable with disperse dyestuffs.

8. A process according to claim 1 wherein the non-ionic surfactant is selected from the group consisting of propylene oxide/ethylene oxide block polymers, addition products of $C_{2-3}$ alkylene oxides with fatty alcohols, addition products of $C_{2-3}$ alkylene oxides with fatty amines, fatty acid polyglycol esters, ethoxylated fatty acid alkanolamides and addition products of $C_{2-3}$ alkyline oxides with linear and branched higher alkyl-substituted phenols; the anionic surfactant is selected from the group consisting of fatty acids and their alkali metal, ammonium and organic base salts, carboxylation products of ethoxylated fatty alcohols, sulphates and sulphonates of fatty acids, sulphates and sulphonates of fatty acid esters and amides, linear and branched $C_{5-18}$ alkyl sulphates and sulphonates, sulphates of ethoxylated fatty alcohols, sulphates of ethoxylated fatty amines, sulphates of ethoxylated fatty acid alkanolamides, sulphated ehtoxylated linear and branched higher alkyl-substituted phenols, polycarboxylic acid ester sulphonates, $C_{5-18}$ alkylbenzenesulphones, $C_{1-4}$ alkylnaphthalenesulphonates and di-$C_{1-4}$ alkylnaphthalenesulphonates; and the cationic surfactant is selected from the group consisting of compounds whose molecules contain at least one lipophilic aliphatic residue having at least 5 carbon atoms and at least one cationic nitrogen atom.

9. A process according to claim 2 wherein the non-ionic surfactant is selected from the group consisting of propylene oxide/ethylene oxide block polymers, addition products of 1 to 100 mols of $C_{2-3}$ alkylene oxide with $C_{5-22}$ aliphatic alcohols, addition products of 5 to 200 mols of $C_{2-3}$ alkylene oxide with aliphatic fatty amines and polyamines in which the fatty group contains 5 to 22 carbon atoms, polyoxyethylene esters of $C_{5-22}$ fatty acids, ethoxylated alkanolamides of $C_{5-22}$ fatty acids and addition products of 1 to 30 mols $C_{2-3}$ alkylene oxide with linear and branched $C_{5-18}$ alkyl- and dialkylphenols; and the anionic surfactant is selected from the group consisting of $C_{5-18}$ long chain saturated and unsaturated carboxylic acids and their alkali metal, ammonium and organic base salts, carboxymethylation products of addition products of 1 to 100 mols ethylene oxide with $C_{5-22}$ aliphatic alcohols, sulphates and sulphonates of $C_{5-18}$ long chain carboxylic acids and of the esters and amides of such acids, linear and branched $C_{5-18}$ alkyl sulphates and sulphonates, sulphates of addition products of 1 to 100 mols ethylene oxide with aliphatic $C_{5-22}$ alcohols, sulphates of addition products of 5 to 200 mols ethylene oxide with aliphatic fatty amines and polyamines in which the fatty group contains 5 to 22 carbon atoms, sulphates of ethoxylated alkanolamides of $C_{5-22}$ fatty acids, sulphates of addition products of 1 to 30 mols ethylene oxide with linear and branched $C_{5-18}$ alkyl- and dialkylphenols, polycarboxylic acid ester sulphonates, $C_{5-18}$ alkylbenzene sulphonates and $C_{1-4}$ alkyl- and di-$C_{1-4}$ alkylnaphthalene sulphonates.

10. A process according to claim 1, in which component (ii) is selected from starches, cellulose derivatives, natural gums, proteins, modified polysaccharides, polyvinyl alcohol, polyvinyl acetate, polyacrylates and polymethacrylates and their copolymers, styrene-maleates, hydrosoluble polyesters, polyethyleneglycols, saponifiable sulphited wax, oil emulsions, paraffin emulsions, synthetic waxes, stearic acid and triglycerides.

11. A process according to claim 8, in which component (ii) is selected from starches, cellulose derivatives, natural gums, proteins, modified polysaccharides, polyvinyl alcohol, polyvinyl acetate, polyacrylates and polymethacrylates and their copolymers, styrene-maleates, hydrosoluble polyesters, polyethyleneglycols, saponifiable sulphited wax, oil emulsions, paraffin emulsions, synthetic waxes, stearic acid and triglycerides.

12. A process according to claim 9 wherein component (ii) is selected from potato starch, maize starch, rice starch, carboxymethyl cellulose, hydroxymethyl cellulose, methyl cellulose, ethyl cellulose, locust bean gum, tragacanth, glue, gelatin, casein, modified polysaccharides, polyvinyl alcohol, polyvinyl acetate, polyacrylates and polymethacrylates and their copolymers, styrene-maleates, hydrosoluble polyesters, polyethylene glycols, saponifiable sulphited wax, oil emulsions, paraffin emulsions, synthetic waxes, stearic acid and triglycerides.

13. A process according to claim 4 in which component (ii) is present in the dyeing liquor or printing paste in an amount from 0.1 to 20%, dry weight, based on the weight of the sized substrate.

14. A process according to claim 3, in which component (i) is present in the dyeing liquor or printing paste in an amount from 1 to 100 g/l and component (ii) is present in the dyeing liquor or printing paste in an amount from 0.1 to 20% dry weight based on the weight of the sized substrate.

15. A process according to claim 10, in which component (i) is present in the dyeing liquor or printing paste in an amount from 1 to 100 g/l and component (ii) is present in the dyeing liquor or printing paste in an amount from 0.1 to 20% dry weight, based on the weight of the sized substrate.

16. A process according to claim 12, in which component (i) is present in the dyeing liquor or printing paste in an amount from 1 to 100 g/l and component (ii) is present in the dyeing liquor or printing paste in an amount from 0.1 to 20% dry weight based on the weight of the sized substrate.

17. A process according to claim 1 in which the textile substrate comprises cotton, cellulose acetate, polyester, polyamide, polyacrylonitrile or a blend thereof.

18. A process according to claim 7 wherein the textile substrate comprises a cellulose acetate.

19. A process according to claim 11 wherein the textile substrate comprises cottom, cellulose acetate, polyester, polyamide, polyacrylonitrile or a blend thereof and the dyestuff is one that is suitable for the substrate and selected from the group consisting of anionic, cationic and disperse dyestuffs.

20. A process according to claim 17 wherein the textile substrate comprises a cotton.

21. A process according to claim 19 wherein the textile substrate comprises cotton.

22. A process according to claim 11 in which the dyeing liquor or printing paste contains a disperse dyestuff and the substrate is a substrate dyeable with disperse dyestuffs.

23. A dyeing liquor or printing paste comprising one or more disperse dyestuffs and (i) 30 to 70 g/l of a non-ionic, anionic or cationic surfactant or mixture and (ii) a testile size or mixture of textile sizes.

24. A composition according to claim 23, in which component (ii) is selected from starches, cellulose derivatives, natural gums, proteins, modified polysaccharides, polyvinyl alcohol, polyvinyl acetate, polyacrylates and polymethacrylates and their copolymers, styrene-maleates, hydrosoluble polyesters, polyethyleneglycols, saponifiable sulphited wax, oil emulsions paraffin emulsions, synthetic waxes, stearic acid and triglycerides.

25. A composition according claim 24 wherein component (ii) is present in an amount of 5–70 g/l.

26. A process according to claim 22 wherein the textile substrate comprises cellulose acetate.

* * * * *